US008172734B2

(12) United States Patent
Anderson

(10) Patent No.: US 8,172,734 B2
(45) Date of Patent: May 8, 2012

(54) DUMBBELL WITH ANTIMICROBIAL HANDLE

(75) Inventor: Karl Anderson, Glendora, CA (US)

(73) Assignees: Ace Specialty, Inc., Rosemead, CA (US); Grace Premier Fitness and Wellness Products, Inc., Vancouver, WA (US)

( * ) Notice: Subject to any disclaimer, the term of this patent is extended or adjusted under 35 U.S.C. 154(b) by 0 days.

(21) Appl. No.: 12/646,252

(22) Filed: Dec. 23, 2009

(65) Prior Publication Data

US 2011/0152042 A1 Jun. 23, 2011

(51) Int. Cl.
*A63B 21/072* (2006.01)

(52) U.S. Cl. ..... 482/108; 482/107

(58) Field of Classification Search ..... 482/106–108, 482/92, 93

See application file for complete search history.

(56) References Cited

U.S. PATENT DOCUMENTS

| | | | | |
|---|---|---|---|---|
| 4,566,690 | A * | 1/1986 | Schook | 482/108 |
| 6,120,420 | A * | 9/2000 | Pearson et al. | 482/108 |
| 6,261,211 | B1 * | 7/2001 | Suarez et al. | 482/107 |
| 7,780,582 | B2 * | 8/2010 | Anderson | 482/107 |
| 7,789,813 | B2 * | 9/2010 | Anderson | 482/107 |
| 2004/0072662 | A1 * | 4/2004 | Landfair | 482/106 |
| 2007/0072753 | A1 * | 3/2007 | Ong | 482/148 |
| 2009/0156367 | A1 * | 6/2009 | Harris et al. | 482/49 |
| 2009/0247369 | A1 * | 10/2009 | Chang | 482/49 |
| 2010/0292054 | A1 * | 11/2010 | Karpus et al. | 482/122 |

OTHER PUBLICATIONS http://www.nickel-alloys.net/copper_nickel_alloys.html.*
http://www.copperinfo.co.uk/alloys/copper-nickel/.*
http://www.antimicrobialcopper.com/us/partner-resources/antimicrobial-copper-manufacturer/physical-properties-and-characteristics.aspx.*
http://www.nickel-alloys.net/copper_nickel_alloys.html Jul. 16, 2006.*
http://www.copperinfo.co.uk/alloys/copper-nickel/ Dec. 25, 2008.*
http://www.antimicrobialcopper.com/us/partner-resources/antimicrobial-copper-manufacturer/physical-properties-and-characteristics.aspx 2010.*
"Copper-Jacketed Germ Buster"; Machine Design; Dec. 13, 2007; pp. 78-80.
Press Release; Copper Development Association; www.copper.org; Mar. 25, 2008.

* cited by examiner

*Primary Examiner* — Allana Lewin
(74) *Attorney, Agent, or Firm* — Seldon & Scillieri

(57) ABSTRACT

A dumbbell having an antimicrobial handle comprises a bar having a pair of end regions, and extending generally longitudinally therebetween along a generally central axis, weight plate masses mounted at the end regions and mechanically secured thereto, and a pair of collars located at longitudinally opposed positions on bar to define a handle region therebetween. A handle is located within the handle region and includes a generally tubular grip surface member supported by the bar and formed from an antimicrobial copper alloy, the generally tubular grip surface member extending generally axially between longitudinally spaced-apart end regions. The pair of longitudinally-spaced generally annular collars have axially-inwardly extending flange portions sized and structured to substantially circumscribe the end regions of the generally cylindrical grip surface member and to securely capture the end regions between the flange portions and the bar.

8 Claims, 2 Drawing Sheets

DUMBBELL WITH ANTIMICROBIAL HANDLE

FIELD OF THE INVENTION

This invention pertains to exercise apparatus of the strength-training type employing a source of resistance against a user's exercise movement, a handle gripped by the user during the exercise movement, and means coupling the handle to the resistance source for permitting the user's exercise movement to be resisted by the source.

Examples of such equipment are barbells, dumbbells, kettlebells and strength-training machines. The term "strength training machines", as used herein, means machines employing a source of resistance against a user's exercise movement, a handle gripped by the user during the exercise movement, and means coupling the handle to the resistance source for permitting the user's exercise movement to be resisted by the source (the handle and coupling means being collectively referred to as a "cable attachment"). Examples include machines that utilize adjustable stacks of weight plates as a resistance source such as the popular Nautilus® machine, machines which utilize flexible rods or straps coiled around a cam to provide resistance in lieu of weight plates, such as the popular Bowflex® machines, and machines using hydraulic or pneumatic cylinders to provide resistance to such movement.

For the sake of brevity, the term "weight plate device" as used throughout shall refer, individually and collectively, to dumbbells, bar bells and kettlebells. The term "dumbbell" as used throughout shall refer, individually and collectively, to dumbbells and barbells.

As is known to those of ordinary skill in the art, dumbbells (with the exception of kettlebells) comprise a bar that extends generally axially between opposing end regions, a weight plate mass mounted about the bar at each end region, means for retaining the mounted weight plate masses at the respective end regions to define a handle region axially inward of the weight plate masses that can be gripped by a user during exercise movement of the dumbbell, and means for securing the weight plate masses to the dumbbell. A kettlebell is a weight having a typical appearance akin to a cannonball with an affixed handle, although other shapes are known in the art as well.

Fitness facilities are often faced with outbreaks of dangerous and potentially deadly staph and MSRA infections. Outbreaks in high school and college locker rooms, professional sports training facilities and physical therapy centers have been documented. Fitness equipment such as dumbbell handles and the gripping surfaces of strength-training machines provide ideal breeding grounds for harmful bacteria that can easily spread among users, particularly since they often neglect to clean equipment after use.

SUMMARY OF THE INVENTION

Exercise apparatus of the strength-training type comprises a source of resistance against a user's exercise movement, a handle gripped by the user for movement during the exercise movement, and means coupling the handle to the resistance source to permit the user's exercise movement to be resisted by the source. The handle is formed with an outer antimicrobial copper gripping surface positioned to be gripped by the user during the exercise movement.

These and further details of the invention will be apparent to those of ordinary skill in the art from reading a description of the preferred embodiment of the invention described below, and of which the drawing forms a part.

DESCRIPTION OF THE DRAWING DRAWINGS

DETAILED DESCRIPTION

Figure 1:
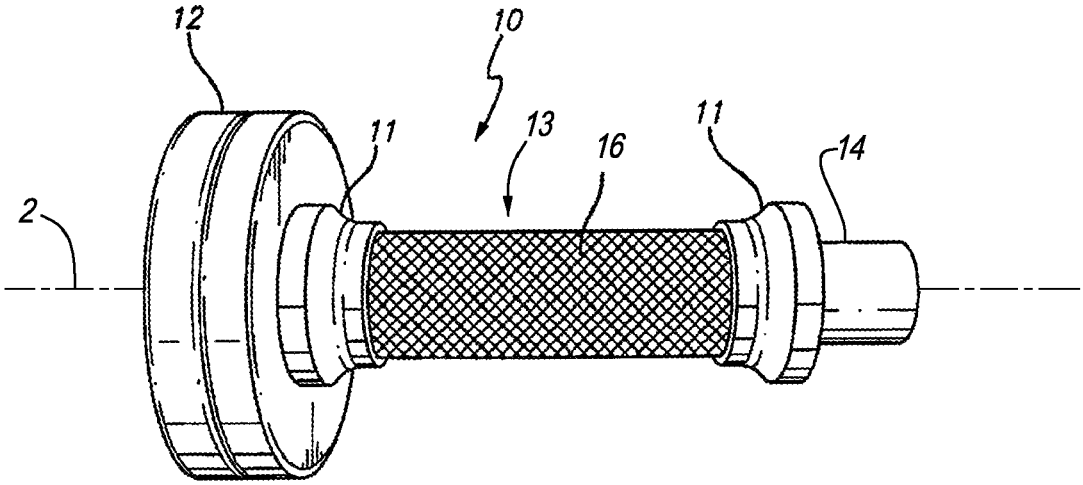
FIG. 1 is a front elevation view showing a dumbbell constructed in accordance with the invention herein.

FIG. 1 is a front elevation view showing a dumbbell constructed in accordance with the invention herein.

The illustrated dumbbell 10 has, by way of example, weight plate masses in the form of a pair of generally annular weight plates 12 mounted in the conventional manner at opposite end regions of a longitudinally-extending bar 14 and mechanically secured thereto in the conventional manner as, for example, as by press fitting the plates onto the bar and/or welding or bolting them in place. (The weight plate mass at the right end region has not been illustrated in FIG. 1 in order to better illustrate the bar 14.) The weight plates 12 abut respective collars 11 which are located at longitudinally opposed positions on bar 14 to define a handle region 13 therebetween that is gripped by the user.

The handle 13 has an outer grip surface 16 formed from an antimicrobial copper alloy, preferably a cuprous nickel alloy containing approximately 80% copper and 18-20% nickel. Copper kills more than 99.9% of bacteria within 2 hours of exposure, and continues killing more than 99.9% even after repeated contamination. Testing has demonstrated copper's effectiveness against such viruses as *staphylococcus aureus, enterobacter aerogenes, Escherichia coli* 0157:H7, *pseudomonas aeruginosa* and methicillin-resistant *staphylococcus aureus* (MSRA).

Copper, however, is a soft metal that cannot withstand the forces that come to bear when strength-training forces are applied to the handle of dumbbells, kettlebells and other s exercise apparatus of the strength-training type.

The preferred cuprous nickel alloy described above does not tarnish, and thereby maintains an attractive appearance as well as an effective microbe-killing functionality. However, the bar on which the weight plate mass is mounted is typically steel, and one cannot weld copper to steel.

Figure 2:
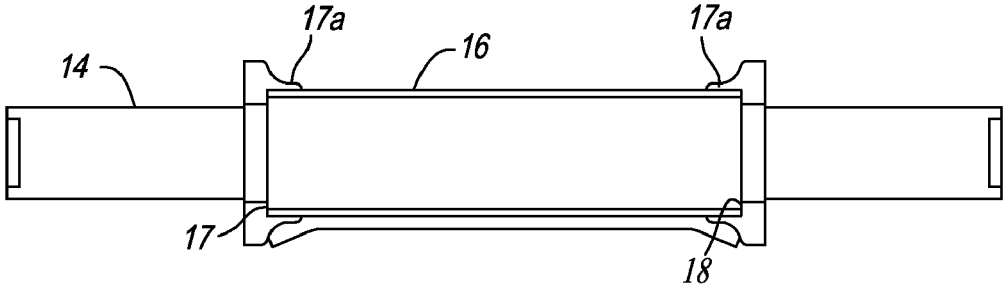
FIG. 2 is a longitudinal sectional view in schematic of a bar and handle for the dumbbell of FIG. 1 constructed in accordance with the invention.

In accordance with the invention, the preferred bar 14 is formed from steel and has a 1.25 inch outer diameter that has been turned down to 1 inch, except within the handle region 13, thereby creating (as shown schematically in FIG. 2) a pair of shoulders 17, 18 at the interfaces. A preferred cuprous nickel tube 16 having a 1.375 inch (35 mm) outer diameter ("O.D.") and a 1.250 inch (31.75 mm) internal diameter ("I.D.) is slid over the handle region of the bar. A pair of generally annular collars 11 preferably formed from antimicrobial brass or copper, and more preferably from the same alloy as the tube 16, are slid onto the bar 14 from respective ends of the bar. The collars have respective axially-inward facing flange portions 17*a* which are sized to circumscribe the end regions of the cuprous nickel tube. The collars are slid axially inward along the bar from the respective ends of the bar until the flange portions circumscribe the end regions of the cuprous nickel tube. The flange portions 17*a* are structured to be diametrically reduced, as by crimping or similar methodology, to securely press fit the collar (and the relatively soft cuprous nickel underlying the flange portions) against the bar 14, resulting in an antimicrobial handle that resists bending when the dumbbell is in use. Those skilled in the art will recognize that means other than press fitting the collars on the bar could be used (e.g., glue), although these alternatives are not viewed as favorably.

Figure 3:
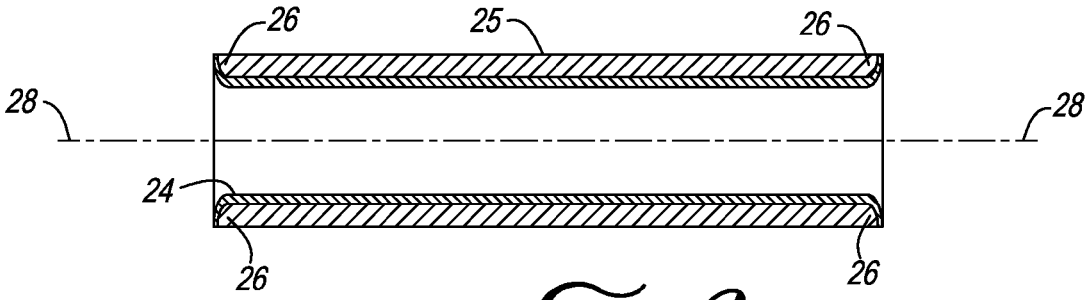
FIG. 3 is an alternative handle for the dumbbell of FIG. 1 constructed in accordance with the invention.

Those skilled in the art will also recognize that the steel bar 14 could be tubular rather than solid steel. Further, as illustrated in FIG. 3, a tubular bar 24 can alternatively be flared outward (as at 26) to secure the cuprous nickel tube 25 against axial movement within the outwardly flared ends 26.

In addition, the handle can be permitted to rotate about the bar's central axis 28 in order to reduce or eliminate any rotational handle torque otherwise experienced by a user as the handle is gripped during certain exercise movements. Rotational movement can be permitted, for example, by placing the bar within a steel tube that forms a substrate for the antimicrobial grip surface, providing one or more bearings or bearing surfaces between the steel tube and bar to permit substantially friction-free rotation of the steel tube (and antimicrobial copper tube affixed thereabout) about the shaft, and mounting the weight plate masses on the axially outward end regions of the shaft.

Those of ordinary skill in the art will recognize that kettlebells and strength training machines can be produced with the handles described above. In the case of the kettlebell, the handle is affixed to the weight.

Figure 4:
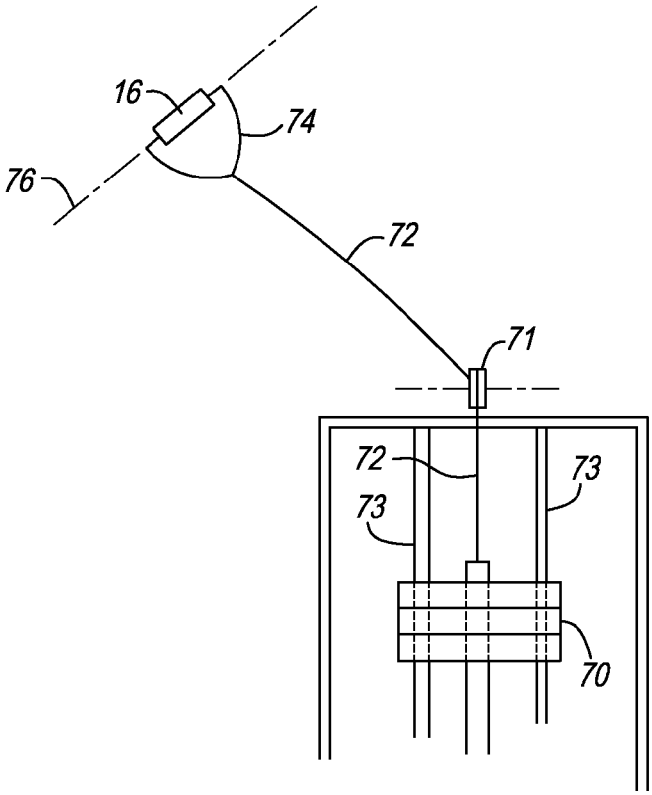
FIG. 4 is a schematic illustration of a cable attachment for a strength-training machine constructed in accordance with the invention.

In the case of a strength training machine, the handle is mechanically coupled to the source of resistance via a cable or other structure coupled to the handle. FIG. 4 is a schematic illustration of a handle for a strength-training machine constructed in accordance with the invention. The illustrated machine is of the type employing an adjustable stack of weight plates as a resistance source. The adjustable stack of weight plates 70 is lifted by a user who is pulling them upward by handle 16 coupled to the weight plate stack via a strap or cable 72 that extends over a pulley 71. The stack of weight plates is guided by guide rods 73, which guide the stack's movement vertically, and keep the plates evenly stacked as they move.

The handle 16 is preferably constructed as previously described in this Detailed Description, and is typically coupled to the cable via a yoke 74 and typically permitted to rotate about a central axis 76 by means of one or more bearing structures that couple the handle to the yoke. One effective arrangement is the use of a tubular nylon bushing underlying the antimicrobial copper alloy tube as an interface between the (rotatable) alloy tube and a non-rotating shaft, bolted or otherwise affixed to the yoke, to provide a low friction means for permitting the rotation. Other bearing arrangements are well known in the art.

Although the present invention and its advantages have been described in detail, it should be understood that various changes, substitutions and alterations can be made herein without departing from the spirit and scope of the invention as will be defined by appended claims.

I claim:

1. A dumbbell comprising:

a bar having a pair of end regions, and a central region extending generally longitudinally therebetween along a generally central axis, the bar having a shoulder at the interface of the central region and each end region;

weight plate masses mounted at the end regions and mechanically secured thereto; and a pair of annular collars located at longitudinally opposed positions on the bar to define a handle region therebetween, a handle being located within the handle region and including a generally tubular grip surface member supported by the bar and formed from an antimicrobial copper alloy, the generally tubular grip member extending generally axially between longitudinally spaced-apart end regions and having a crimped end portion overlying the shoulders that is sufficiently reduced dimensionally to create a securing press fit against the bar, the pair of longitudinally-spaced generally annular collars having axially-inwardly extending flange portions sized and structured to substantially circumscribe the crimped end regions of the generally cylindrical grip surface member.

2. The dumbbell of claim 1 wherein the antimicrobial copper alloy is a cuprous nickel alloy.

3. The dumbbell of claim 2 wherein the collars have crimped flanges overlying the shoulders that are sufficiently reduced dimensionally to create a securing press fit between the generally tubular grip surface member and the bar and securely capture said end regions between the flange portions and the bar.

4. The dumbbell of claim 2 wherein the alloy contains approximately 80% copper.

5. The dumbbell of claim 2 wherein the alloy contains approximately 18-20% nickel.

6. The dumbbell of claim 1 the axially-inward extending flange portions are sized and structured to securely compress the generally tubular grip surface member between the flange portions and the bar.

7. The dumbbell of claim 6 wherein the end regions of the generally tubular grip surface member are captured between the flange portions and the bar via a diameter-reduction operation imposed on the flange regions.

8. The dumbbell of claim 1 wherein the collars are made from an antimicrobial copper alloy.

* * * * *